US005519914A

United States Patent [19]

Egan

[11] Patent Number: 5,519,914

[45] Date of Patent: May 28, 1996

[54] CONTACT TYPE AUTOMATIC ROLL CLEANER

[76] Inventor: Ronald G. Egan, 945 Joylene Dr., Webster, N.Y. 14450

[21] Appl. No.: 510,014

[22] Filed: Aug. 1, 1995

[51] Int. Cl.[6] ..... B08B 1/00; B08B 13/00

[52] U.S. Cl. ..... 15/256.53; 101/425; 355/300

[58] Field of Search ..... 15/256.5, 256.51, 15/256.53; 101/425; 355/300, 296

[56] References Cited

U.S. PATENT DOCUMENTS 5,251,348 10/1993 Corrado et al. ..... 15/256.53

5,275,104 1/1994 Corrado et al. ..... 15/256.53 X

*Primary Examiner*—Edward L. Roberts, Jr.

*Attorney, Agent, or Firm*—Shlesinger, Fitzsimmons & Shlesinger

[57] ABSTRACT

Cleaning cloth supply and take-up spools are mounted by rodless supports for rotation about spaced, parallel axes in a frame that is connected to a pneumatic cylinder for reciprocation between opposite ends of a rotating process roll the surface of which is to be cleaned. The cleaning cloth passes over an opening in the frame, and a sponge pressure pad, which is saturated with cleaning fluid, is mounted in the frame to reciprocate toward and away from the opening between an advanced position in which it engages, saturates and urges the registering portion of the clean cloth into contact with the surface of the rotating processing roll, and a retracted position in which the sponge is drawn into the frame completely to disengage the cloth, which therefore disengages the processing roll. The sponge pad retracts and a clean section of cloth is advanced over the frame opening each time the frame reaches one of its limit positions. The take-up and supply spool mounts are adjustable to preset the tension which is developed in the cleaning cloth during its use.

13 Claims, 5 Drawing Sheets

CONTACT TYPE AUTOMATIC ROLL CLEANER

BACKGROUND OF THE INVENTION

This invention relates to a roll cleaning apparatus, and more particularly to an improved, modular-type roll cleaner which is substantially more compact and efficient than prior roll cleaner devices. Even more particularly this invention relates to an improved roll cleaner device having improved means for adjusting the associated cleaner cloth and sponge which applies cleaning fluid to a roll.

Heretofore contact cleaner rolls of the type described have tended to be extremely large and cumbersome in operation. U.S. Pat. No. 5,251,348, for example, discloses a contact cleaner roll assembly of the type in which a cloth cleaning roll, together with its feed roll and takeup roll are mounted on the first frame for movement as a unit radially toward and away from the process roll the surface of which is to be cleaned. The first frame, in turn, is supported on a second frame which is mounted on the machine frame for movement axially of the process roll which is to be cleaned, or in a direction normal to the direction of which the first frame is movable on the second frame. The cloth cleaning roll, which is supplied with a cleaning fluid, is urged radially into engagement with the process roll which is to be cleaned, and then is moved axially of the rotating process roll to clean its surface. Periodically the cloth is advanced to introduce a clean section of the cloth to the surface of the process roll which is being cleaned. While this apparatus is effective in cleaning process rolls, it nevertheless constitutes a rather large and expensive structure which makes it unsuitable for certain installations.

A variation of this apparatus is shown in U.S. Pat. No. 5,275,104, wherein instead of mounting the cleaning cloth for travel axially of the surface of the process roll that is being cleaned, the width of the cleaning cloth corresponds to the axial length of the process roll that is being cleaned, so that the tangential section of the cloth cleaning roll, which engages the surface of the process roll, extends axial length of the process roll. During a cleaning operation, a special, so-called "touch roll", which also is equal in length to the axial length of the process roll, is engaged behind the cleaning cloth to urge it into cleaning engagement with the surface of the rotating process roll. While this alternative method of cleaning a process roll has the advantage of eliminating the need for using a frame for shifting the cleaning cloth axially of the process roll that is being cleaned, it nevertheness also is unsuitable for certain operations.

It is an object of this invention, therefore, to provide an improved contact roll cleaner which is substantially smaller and inexpensive to manufacture and install, as compared to prior contact roll cleaners.

Another object of this invention is to provide an improved contact roll cleaner of the type described, which because of its compact size can be employed to clean a much larger variety of process rolls of different sizes and types, as compared to prior such roll cleaners.

A further object of this invention is to provide an improved contact roll cleaner of the type in which the pressure pad or sponge, which supplies cleaning fluid to the cleaning cloth is completely disengaged from the cloth when the cleaner is in its retracted or inoperative position.

Still another object of this invention is to provide improved rodless means for removably mounting the cloth take-up and supply rolls in a contact cleaner of the type described, and which permits the presetting of the desired tension that is to be developed in the cleaning cloth during its use.

Other objects of the invention will be apparent to those skilled in the art when the preferred embodiments are considered in conjunction with the accompanying drawings and the appended claims.

SUMMARY OF THE INVENTION

A cloth take-up spool and a cleaning cloth supply roll spool are mounted by rodless supports for rotation about spaced, paralled axes between the two sidewalls of a frame, which is adjustably mounted at its upper end on a pneumatic cylinder for reciprocation thereby adjacent to, and axially back and forth between opposite ends of a rotating process roll the surface of which is to be cleaned. The cleaning cloth passes over the lower ends of the frame sidewalls that face the processing roll. A sponge pressure pad, which is saturated with cleaning fluid, is mounted between the lower ends of the sidewalls to reciprocate between an advanced position in which it engages and saturates the registering portion of the cleaning cloth while simultaneously urging the saturated portion into contact with the surface of the rotating processing roll that is to be cleaned, and a retracted position in which the sponge is drawn upwardly into the frame completely to disengage the cloth, which therefore disengages the processing roll.

Also, the means for mounting the take-up and supply rolls in the frame are adjustable to preset the tension which is developed in the cleaning cloth during its use, thereby obviating the need for setting or adjusting the tension each time a new roll of cleaning cloth is mounted in the support.

THE DRAWINGS

DETAILED DESCRIPTION OF THE PREFERRED EMBODIMENTS

Figure 1:
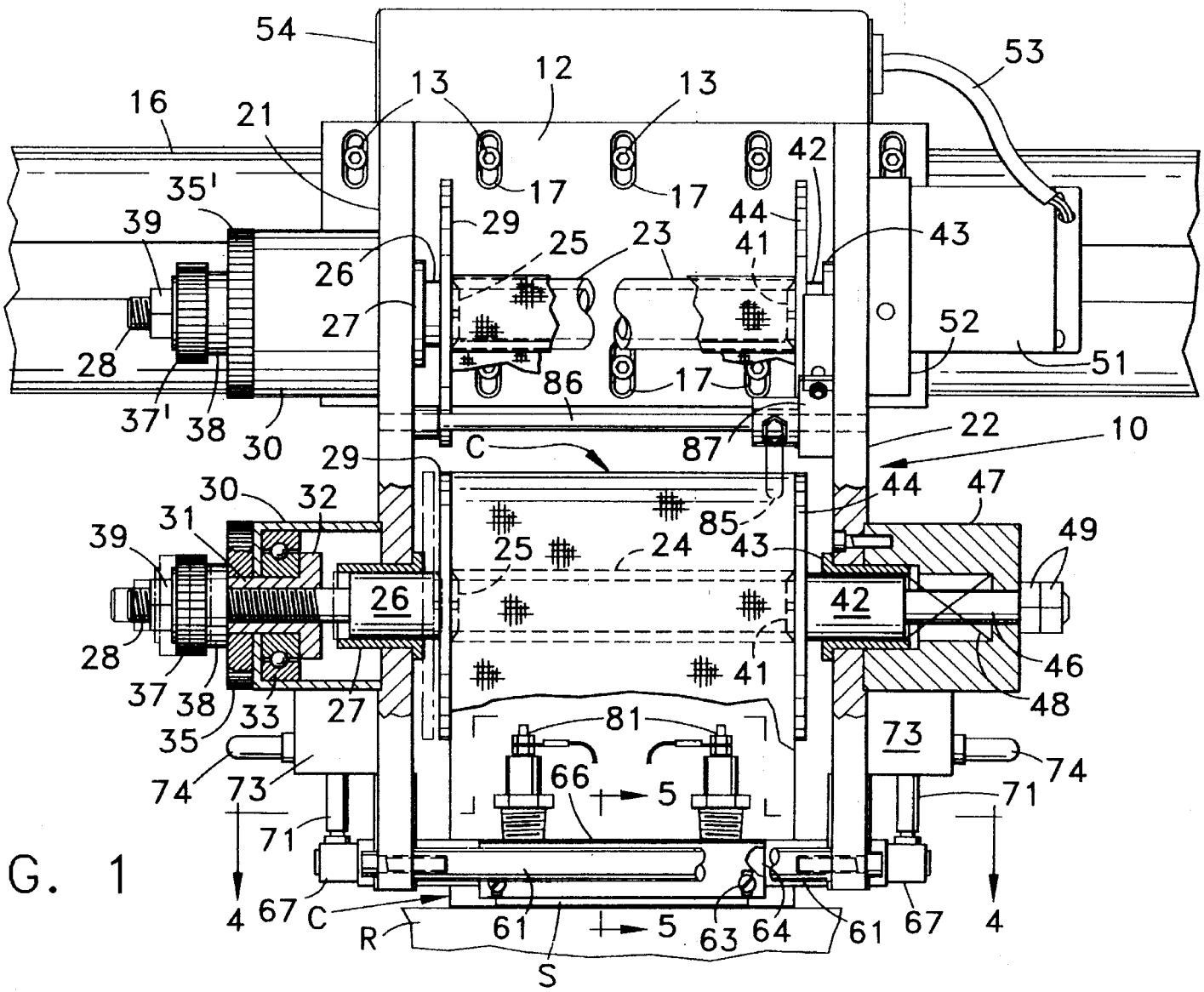
FIG. 1 is a fragmentary front elevation view of an improved contact type roll cleaner and support therefor made according to one embodiment of this invention, portions of the cleaner being broken away and shown in section.

Referring now to the drawings by numerals of reference, and first to FIG. 1, 10 denotes generally the frame of an improved roll cleaner having a back wall or bracket 12 adjustably secured by a plurality of screws 13 to a support 14, which forms part of an elongate pneumatic cylinder 16, and which is mounted for movement longitudinally thereof as noted hereinafter. The bracket 12 has therein a plurality of vertically extending slots 17 through which pass the shanks of the screws 13, so that when the screws are loosened frame 10 can be adjusted vertically relative to the support 14 of the associated cylinder 16 for a purpose noted hereinafter.

Frame 10 has a pair of spaced, parallel side walls 21 and 22 between which are removably mounted two tubular spools or spindles 23 and 24 which are disposed to form, respectively, the takeup roll and supply roll for a cloth cleaning fabric that is denoted generally the letter C in the drawings. Each of the spools 23 and 24 has snugly and releasably secured coaxially in its bore at one end thereof (the left end as shown in FIG. 1) the externally knurled or fluted end 25 of one of two identical cylindrical spool supports 26, each of which is mounted for limited axial movement in the bore of one of two bronze bearings 27, that are secured in registering openings in the frame side wall 21. (Since the spool mounting mechanisms for the left ends of the spools 23 and 24 as shown in FIG. 1 are identical, only one thereof will be described in further detail herein.) Each spool support 26 has integral with and projecting coaxially from its opposite end (the left end thereof as shown in FIG. 1) a reduced-diameter, externally threaded shank 28, and has formed thereon intermediate its ends an enlarged-diameter circular flange 29 that is located between its fluted end 25 and its associated bearing 27.

The shank 28 of each support 26 extends coaxially through the bore of an annular end cap 30, which has an open end secured in the outer surface of the end wall 21 coaxially of its associated bearing 27, and in radially spaced relation thereto. Intermediate its ends each shank 28 threads through the internally threaded bore of an adjusting sleeve 31, which at one end extends coaxially into the bore of its associated end cap 30 and has thereon an enlarged-diameter, circumferential collar 32 that is engaged with the rotatable inner race of a ball bearing mechanism 33, the outer, circumferential race of which is press fit coaxially into the bore of the associated end cap 30 intermediate its ends. At its opposite end each sleeve 31 projects coaxially through a registering opening in the outer, closed end of its end cap 30 and has press fit coaxially over its outer end an externally knurled disc or knob 35, which is seated rotatably against the outer end of its end cap 30. The externally threaded shank 28 of each spool support 26 also threads through the internally threaded bore of another externally knurled disc or knob 37, which at one side has a reduced-diameter hub section 38 engaged with the outer face of the adjacent knob 35, and which at its opposite side is engaged by a locking nut 39, that is threaded over the outer, terminal end of the associated shank 28.

As noted above, identical mechanisms are employed for supporting the left ends of the spools 23 and 24. However, when referring to the associated support for the spool 23, the knurled knobs which correspond to the knobs 35 and 37 of spool 24, will be identified by the numerals 35' and 37' respectively Referring now to the opposite ends of the spools 23 and 24 (the ends adjacent to frame wall 22), each has press fit snuggly into its axial bore a knurled or fluted end 41 of a cylindrical spool support 42, which as in the case of the supports 26, are rotatably mounted in bronze bearings 43, which are secured in registering openings in the frame sidewall 22. Like the supports 26, the supports 42 have formed thereon enlarged-diameter circular flanges 44 located between their fluted ends 41 and adjacent bearings 43. However, the cylindrical supports 42 otherwise are not identically mounted in the frame sidewall 22.

For example, the lower cylindrical spool support 42, as shown in FIG. 1, is mounted for limited axial movement in its associated bearing 43, and for this purpose has a reduced-diameter shank 46 that extends coaxially and in radially spaced relation through a counterbore formed in an end cap 47 that is fastened to the outer surface of the frame sidewall 22 coaxially of the associated support 42. A coiled compression spring 48, which is mounted in the counterbore in end cap 47, is engaged at one end of the bottom of the counterbore and at its opposite end with the cylindrical support 42, normally to urge the latter resiliently in the direction of the associated spool 24. Retainer nuts 49, which are secured to the outer end of the shank 46 of the support 42 at the exterior of end cap 47, function to limit the extent to which the spring 48 can urge the associated spool support 42 toward the left in FIG. 1, and against the cloth supply roll spool 24. As noted hereinafter, the spring 48 thus functions resiliently to cause the associated cloth supply roll on spool 24 to be resiliently gripped between the associated flange sections 29 and 44, and helps to create the desired tension in the cloth C.

Unlike the spool support 42 for the supply spool 24, the upper spool support 42 (FIG. 1), which rotatably supports the adjacent end of the take-up spool 23, is not mounted for axial movement in its associated bearing 43, but instead is connected in a conventional manner, which is not illustrated in detail herein, to the drive shaft of a conventional Bodine gear motor 51 that is secured by a mounting plate 52 to the outside of the frame sidewall 22. Motor 51 is connected by a line 53 to a control circuit enclosed in a housing 54 that is mounted on the upper ends of the frame sidewalls 21 and 22 to extend transversely therebetween. As noted in greater detail hereinafter, the motor 51 is energized intermittently to advance cloth C from its roll on supply spool 24 to the take-up spool 23.

Figure 5:
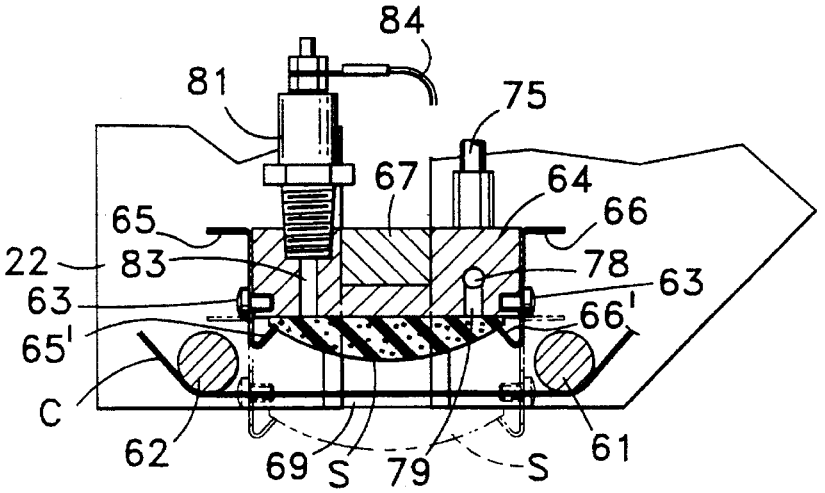
FIG. 5 is a fragmentary sectional view on the same scale as in FIG. 4, but taken along the line 5—5 in FIG. 1 looking in the direction of the arrows.

Mounted at opposite ends thereof in the frame sidewalls 21 and 22 to extend transversely therebetween are two, spaced, parallel cloth guide rolls 61 and 62. Mounted for limited vertical movement in the space between the rolls 61 and 62 for the purpose of urging the cleaning cloth C into operative engagement with the surface of a process roll R that is to be cleaned, is an elongate pressure pad in the form of a sponge S. As shown more clearly in FIG. 5, the sponge S, which normally may be in the form of an elongate, rectangular strip, has one surface thereof secured against the plane underside of an elongate, rectangular support plate 64 by virtue of two clamps 65 and 66, which are secured by screws 63 to opposite sides of the support 64. Clamps 65 and 66 have serrated lower edges 65' and 66', respectively, which curve beneath the lower surface of the support 64 gripingly to engage the longitudinal side edges of the sponge S, the center portion of which is therefore permitted to project beneath the edges 65' and 66' of the clamps in the form of a curved crown (FIG. 5). An elongate, rectangular bar 67, which is secured in a recess in the upper surface of plate 64, extends at opposite ends thereof through registering bearings 68, which support bar 67 adjacent opposite ends thereof for limited vertical movement in slots 69 formed at the lower ends of frame sidewalls 21 and 22.

Outwardly of the frame sidewalls 21 and 22, opposite ends of the bar 67 are secured to the lower ends of the rods or operating shafts 71 of two pneumatic cylinders 73, which are fastened to the outer surfaces of sidewalls 21 and 22 adjacent the upper ends of the slots 69 which permit limited vertical movement of the bar 67. Air is supplied to the cylinders 73 via lines 74 selectively to move their associated shafts 71 to retracted positions in which bar 67, and hence plate 64 and the sponge S are retracted upwardly into inoperative positions above the lower edges of the sidewalls 21 and 22, as shown for example in FIG. 5. In this position the sponge S is spaced above and disengaged from the cleaning cloth C.

Figure 2:
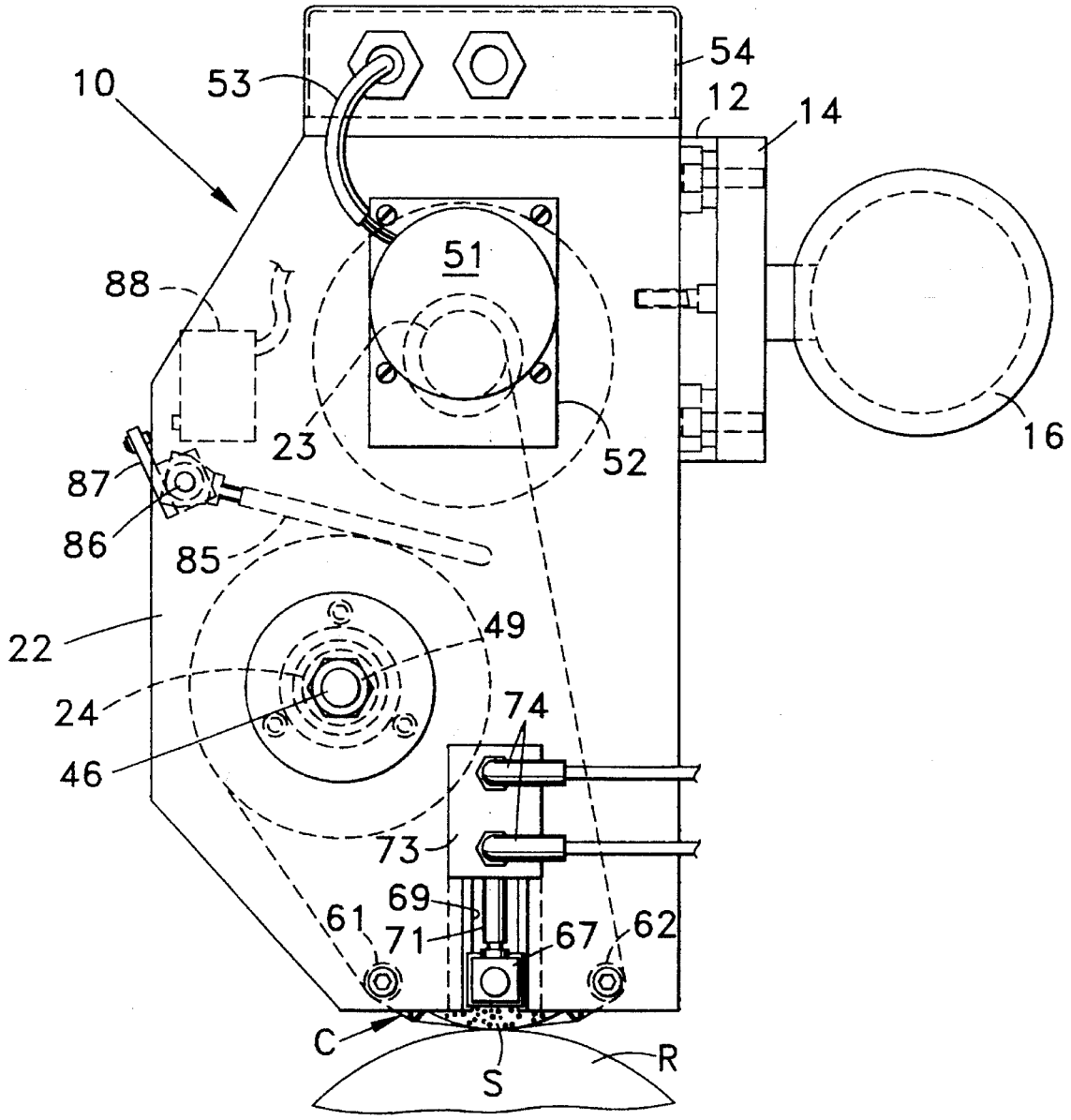
FIGS. 2 and 3 are fragmentary end elevational views of this cleaner and its support as seen when looking at the right and left ends, respectively, of the cleaner as shown in FIG. 1.
Figure 3:
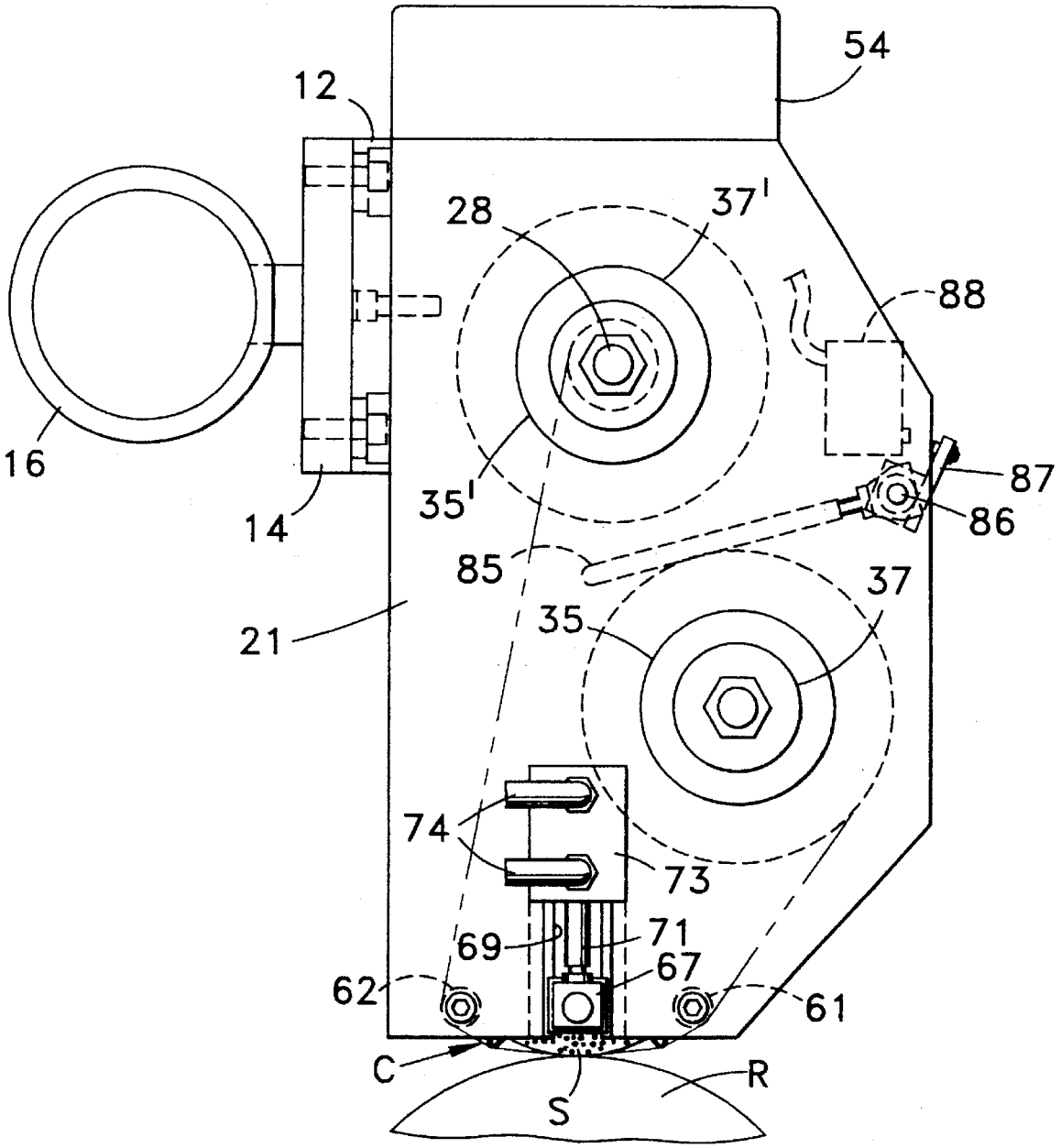

On the other hand, when the cylinders 73 are actuated to extend their associated shafts 71, for example downwardly as in FIG. 1, the sponge S is also urged downwardly into its broken line position as shown in FIG. 5, wherein the sponge S engages and urges the cloth C into operative, cleaning contact with the processing roll R, as shown in FIGS. 1 to 3. In this operative position, as the sponge or pressure pad S is forced against the cloth C, moisture in the sponge is transferred to the cloth, and the cloth is urged by the sponge into contact with the surface of the rotating roll R. When the sponge S is retracted to its inoperative position as shown in FIG. 5, the cloth C likewise is permitted to retract upwardly into the bottom of the frame 10 so that it extends substantially horizontally between the rolls 61 and 62, thereby disengaging the cloth C from the roll R.

Figure 4:
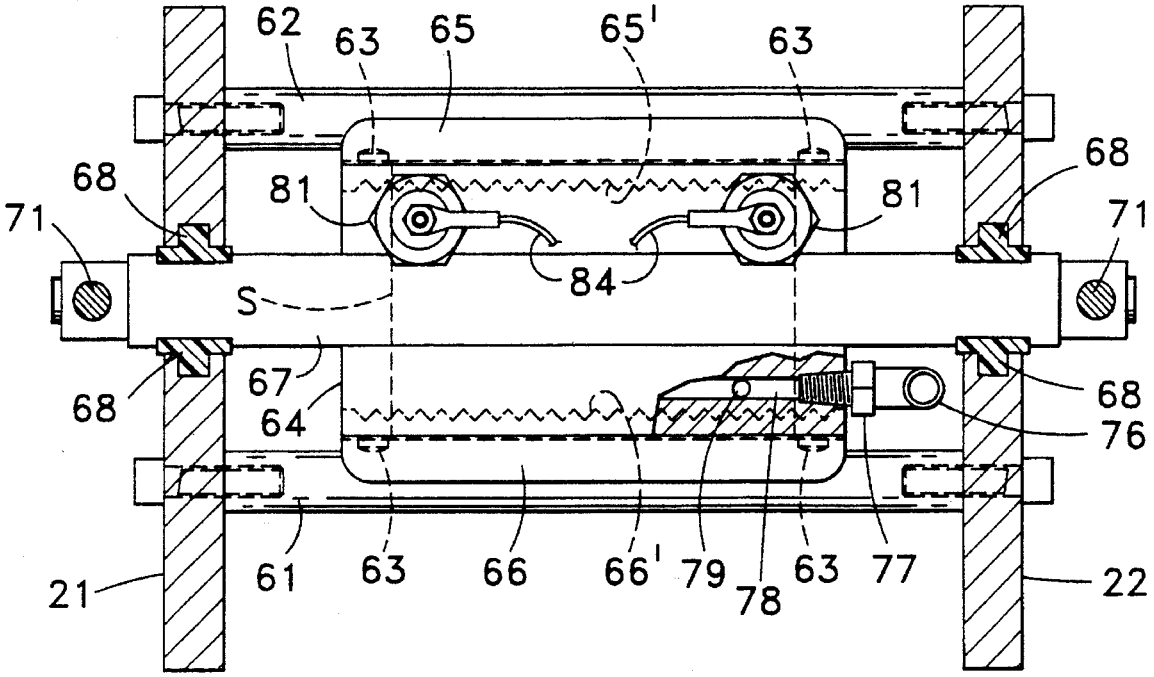
FIG. 4 is an enlarged fragmentary sectional view of this cleaner taken generally along line 4—4 in FIG. 1 looking in the direction of the arrows, but with the cleaning cloth removed.

Referring now to FIGS. 4 and 5, the tube or pipe 76, which supplies cleaning fluid from the supply thereof to the sponge S, is connected at one end thereof by a fitting 77 to plate 64 in communication with an elongate duct 78, which communicates through ports 79 in the plate (only one of which ports is shown in FIGS. 4 and 5), with the underside of plate 64, and the surface of the sponge S which is secured against the plate. Cleaning fluid is supplied, as necessary, to maintain the sponge S saturated, so that when it engages the cloth C it will transfer the cleaning fluid to the cloth. In order to determine whether or not the sponge S is satisfactorily saturated, two moisture sensors 81 (FIG. 4), which may of the type sold by Warrick under the designation 3H1B1, are secured at their lower ends in the upper surface of plate 64 adjacent one side thereof, and with the conductivity probes 83 thereof communicating through registering openings in the plate 84 with the surface of the sponge S that is fastened against the underside of plates 64. Each sensor 81 is capable of developing on its output line 84, via its conductivity probe 83, an electrical signal which can be utilized for causing cleaning fluid to be delivered through the pipe 76 to the sponge S, whenever the sponge falls below its desired saturation.

To monitor the amount of cloth remaining on the supply roll, a cloth sensing arm 85 (FIGS. 2 and 3) is engaged at one end with the roll of cloth on spool 24, and is secured at its opposite end to a rod 86 that is mounted at opposite ends in the frame sidewalls 21 and 22 to pivot about an axis parallel to spool 24. When the arm 85 is engaged with a full cloth roll as in FIG. 3, the arm pivots shaft or rod 86 to a position in which a lug 87 thereon is disengaged from a normally open alarm switch 88 that is mounted on wall 22 adjacent rod 86. However, when the cloth supply roll is nearly empty, arm 85 causes rod 86 to swing lug 87 into engagement with switch 88 to close the latter and energize an alarm to indicate that a new supply roll is required.

In use, the pneumatic cylinder 16, which may be of a conventional type sold by Roessel Co., is mounted on a machine frame (not illustrated) to extend its spaced, parallel relation to the process roll R the surface of which is to be cleaned. In practice the cylinder 16 is positioned on the machine frame in such manner that when the cylinder rods 71 are retracted, and the sponge S and cloth C are in their retracted positions as shown by full lines in FIG. 5, a slight space will exist between the surface of the roll R and the cloth C, and the cloth will extend substantially horizontally between the guide rolls 61 and 62. The presence of the slots 17 in the back wall 12 of the frame 10 permits the frame to be adjusted slightly so that it will assume the necessary space between the roll R and the cloth C, when the sponge S is in its retracted position. This construction thus provides a relatively simple and inexpensive means for adjusting the pressure which is exerted by the cleaning cloth C on the surface of the roll R when the latter is being cleaned by the cloth.

Moreover, another advantage of this configuration is that when the sponge S is moved to its retracted position (upwardly in FIG. 5), it disengages the cloth C, and is spaced from the registering portion of the cloth which extends between the guide rolls 61 and 62. This obviates a problem that existed with prior art cleaners of the type in which the sponge or pad which supplies the cleaning fluid to the cloth remains in contact with the cloth at all times. Such prior construction has the disadvantage that the continued engagement between the cloth and the sponge causes the cloth to wick substantial quantities of fluid from the sponge and eventually resulting in undesirable dripping of the cleaning fluid onto the process rolls and associated equipment and often resulting in damage thereto.

With the construction illustrated herein, the sensors 81 function to supply cleaning fluid to the sponge S only when necesary, thereby preventing any excess moisture collecting in the sponge. And, as noted above, since the sponge is not in contact with the cloth C, except during the actual cleaning of the roll R, there is no need to employ drip pans or the like to collect excess cleaning fluid which might otherwise be transferred to the cloth.

Before (or after) the frame 10 is mounted on the cylinder 16, the take-up spool 23 is mounted in the frame by rotating Knob 37' in a direction to retract the fluted end 25 and flange 29 of the upper support 26 slightly toward the left from its full line position as shown in FIG. 1. The spool 23 is then inserted between the confronting, fluted ends 25 and 41 of the upper set of supports 26 and 42, respectively, and then the knob 37' is rotated back to advance the fluted end 25 and its flange 29 toward the right in FIG. 1 to its operative position in which the registering, fluted ends 25 and 41 are snuggly pressed into opposite ends of the spool 23. The same procedure is then followed to mount the spool 24 of the supply roll between the lower, coaxially disposed supporting cylinders 26 and. 42 as shown in FIG. 1. Again, this is done by rotating knob 37 in a direction to retract the associated flange 29 to its broken line position as shown in FIG. 1, after which spool 24 is positioned between the registering flanges 29 and 44 and the knob 37 is rotated in the opposite direction to shift the lower set of fluted support ends 25 and 41 into opposite ends of spool 24. The leading edge of the cloth C, of course, must be secured to the peripheral surface of the take-up spool 23 before the motor 51 can be operated to advance the cloth from the supply roll to the take-up spool 23.

As noted above, the spring 48 in the end cap 47 urges the associated support 42 axially toward the supply spool 24. The compression force exerted by the support 42 against the spool 24 can be adjusted by rotating the spool 35 relative to the shank 28 of the lower support 26, thereby selectively to increase or decrease the force with which the lower flange 29 is exerted against the cloth supply roll. This adjustment is made until the desired tension is developed in the cloth C during its passage from the supply roll, around the guide roll 61 and 62 to the take-up spool 23. The advantage of this construction is that once the knob 35 has been utilized to adjust its associated cylindrical support 26 into its desired position, the operator of the equipment need not thereafter be concerned with the tension that will be developed in the cloth upon replacing an expired supply spool 24 with a new cloth roll and its associated spool 24. Since the operator need only rotate the knob 37 to insert or remove the spool 24 of a supply roll, without having to rotate the knob 35, which otherwise remains fixed against rotation, the same tension will automatically develop in each successive cloth supply roll mounted between the lower supports 26 and 42, because each time the spool 37 is rotated back to its starting or spool locking position, its hub 38 will always engage the outer end of the adjusting knob 35, so that the associated flange 29 will always be returned to the same operative or full line position as shown in FIG. 1.

The same type of adjustment can be made, if necessary, to the cylindrical support 26 for the upper, take-up roll, simply by adjusting its associated knob 35'.

Figure 6:
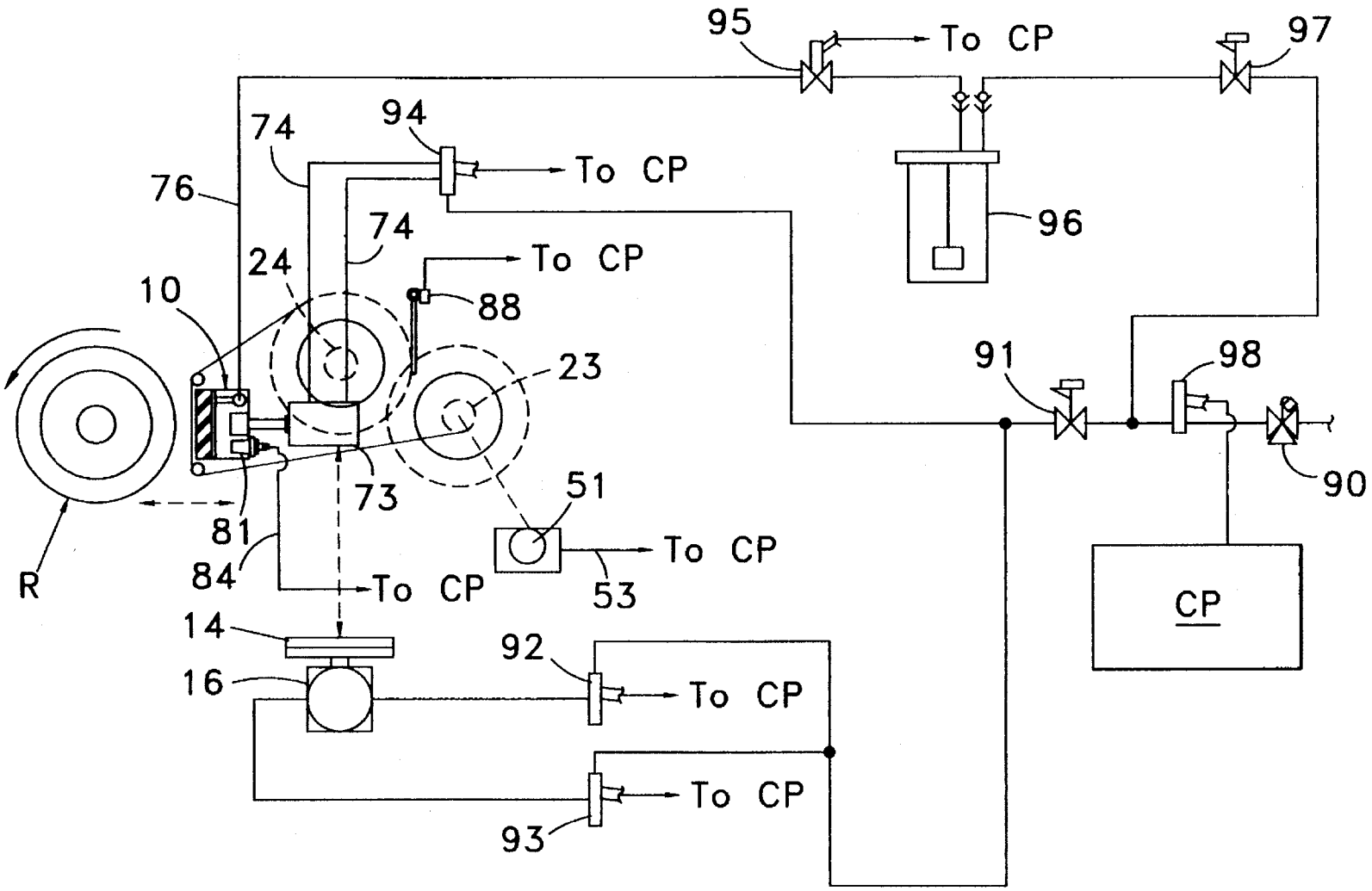
FIG. 6 is a diagram illustrating schematically the controls for operating the cleaner and the cleaning fluid supply.

Referring to FIG. 6, it is possible to use an Allen Bradley SLC 500 programmable controller, or the like, for controlling the operations of the above-disclosed roll cleaner via a control panel CP. For example, compressed air from a supply 90 thereof is supplied through a pressure regulator 91 and selectively via two solenoid-operated valves 92 and 93 to opposite ends, respectively, of the pneumatic cylinder 16. The above-noted proximity switches, which are located at opposite ends of the cylinder 16, are designed to cooperate with valves 92 and 93 to control the reciprocation of the plate 14 longitudinally of cylinder 16, and hence reciprocation of the frame 10 longitudinally of the processing roll R that is being cleaned. In practice, each time that the frame 10 reaches one end of its longitudinal travel relative to the roll R, the associated proximity switch stops further travel of the frame 10 in that particular direction. The programmable controller in the CP then operates another solenoid-operated valve 94 to cause compressed air from supply 90 to actuate the cylindesr 73 to retract the sponge S to its retracted position. The CP controller then momentarily operates the motor 51 to cause the take-up spool 23 to draw a new, clean section of the cloth C across the space between the guide rolls 61 and 62, thus placing a clean section of the cloth in registry with the retracted sponge S. The sponge S is then advanced to its operative position via the valve 94, and the cylinder 16 causes the frame 10 to travel in the opposite direction axially of the now-rotating roll R while the cloth C is engaged with the surface of the roll R. When frame 10 approaches the opposite end of roll R, the other proximity switch associated with cylinder 16 stops further movement of the frame, and the steps of retracting the sponge S and advancing a new section of clean cloth between the guide rolls 61 and 62 are repeated.

Whenever during the operation of the unit the sensors 81 detect that the sponge is not satifactorily saturated, they generate on their output lines 84 signals which are applied to the CP controller, which then actuates another soenoid-operated valve 95 that causes fluid to be supplied from a sealed tank 96 via pipe 76 to the sponge until such time that the probes 83 of the sensors 81 cease to generate output signals. The sealed container 96 is pressurized by compressed air from source 90 via another pressure regulator 97, so that the cleaning fluid in tank 96 is supplied to the sponge pad S via closed pressurized system therefore eliminating any concern that cleaning solvent vapors, other than those originating at sponge S, would escape into the atmosphere near tank 96. Also, an emergency stop, solenoid-operated valve 98 is interposed between the compressed air source 90 and the pressure regulators 91 and 97 to enable instant interruption of the compressed air supply in the event of any leakage in the system.

Another advantage of this invention is that the screws 65' and 66' of the clamps 65 and 66 permit moisture to completely saturate the face of the sponge S, while firmly gripping the sponge along its side edges to prevent it from pulling loose due to axial friction of the process roll during a cleaning operation. Moreover, the screws 63, which secure the clamps 65 and 66 to the support 64, pass through registering, vertical slots in the clamps 65 and 66, thereby permitting the removal of the sponge S for replacement, or the like, simply by releasing the screws 63 and permitting the clamps 65 and 66 to drop slightly downwardly from the positions as shown in FIG. 5, thus releasing the sponge and permitting the insertion of another sponge in its place, after which the clamps 65 and 66 may be shifted upwardly and secured in place by the screw 63 to retain the new sponge in place. This provides a relatively simple and inexpensive means for supporting the sponge on member 64, and also permits simple replacement of the sponge without having completely to remove screws 63 from support 64.

From the foregoing, it will be apparent that the present invention provides a relatively simple, inexpensive and very compact roll cleaner, which can be readily inserted for use in cleaning a great variety of different types of processing rolls, and which is moveable between operative and inoperative positions simply by moving a pressure pad sponge slight distances toward and away from the processing roll which is to be cleaned. Both the take-up spool and the cloth supply spool can be readily inserted into and withdrawn from a rodless support mechanism simply by rotating the associated knurled knobs 37' and 37. Moreover, in order to set the desired tension in the cloth which is to be used for cleaning, one need only adjust the knobs 35 and 35' into preset positions, which will automatically establish the desired tension in the cloth upon insertion of a new cloth roll into the mechanism. The simplified method of advancing the cleaning cloth into engagement with the surface of a processing roll, also has the advantage that when the contact roll mechanism is in its inoperative or sponge retracting position, the sponge S is completely separated from the cloth, so that no undesirable wicking takes place when the unit is not in use. Also the novel clamps 65 and 66, which are employed for retaining the sponge on support 64, provide relatively simple and inexpensive means for easily replacing the sponge S, and also for insuring that the sponge is completely saturated throughout its length. This saturation also is assured by virtue of the two sensors 81, which have their probes in operative engagement with the sponge S to monitor the degree of saturation of the sponge, and automatically to supply additional cleaning fluid to the sponge, when necessary.

Although since the invention has been illustrated and described in detail in connection with only certain embodiments thereof, it will be apparent that it is capable of still further modification, and that this application is intended to cover any such modifications as may fall within the scope of one skilled in the art or the appended claims.

I claim:

1. A contact type roll cleaner, comprising a frame mounted for reciprocation adjacent to and axially of the surface of a rotating processing roll, and with one end of said frame disposed in spaced, confronting relation to said surface of the processing roll, cleaning cloth mounting means removably supporting the tubular spools of, respectively, a cleaning cloth supply roll and a cleaning cloth take-up roll on said frame for rotation about a pair of spaced axes extending parallel to the axis of said processing roll, means for intermittently feeding cleaning cloth from said supply roll to said take-up roll, and in a path which causes at least a part of said cloth to pass over an opening in said one end of said frame, means removably mounting a sponge pad in said opening in said frame for movement between a retracted position in which said sponge pad is spaced from the portion of said cloth then in registry with said opening, and an advanced position in which said sponge pad engages and urges said portion of the cloth into engagement with said surface of said processing roll, and means for maintaining said sponge pad substantially saturated with a cleaning fluid, whereby cleaning fluid is transferred to said registering portion of said cloth upon engagement thereof by said sponge pad.

2. A contact type roll cleaner as defined in claim 1, wherein said means for mounting said sponge pad comprises, an elongate support member mounted adjacent opposite ends thereof in said frame for reciprocation in said opening toward and away from said registering portion of said cloth, and having thereon a pad supporting surface facing said portion of said cloth, and a pair of clamps adjustably secured to opposite sides of said support member and having marginal edge portions thereof overlying said pad supporting surface and grippingly engaged with longitudinal side edges of said sponge pad to secure said pad against said pad supporting surface.

3. A contact type roll cleaner as defined in claim 2, wherein said marginal edge portions of said clamps are serrated and form spaced teeth engaging said side edges of said sponge pad.

4. A contact type roll cleaner as defined in claim 2, wherein said means for maintaining said sponge pad substantially saturated comprises, moisture sensing means mounted on said support member in communication with said sponge pad, and operative to produce an output signal when the moisture content of said sponge pad falls below a predetermined value, said support member having therein a cleaning fluid supply duct having an inlet at one end thereof, and an outlet at its opposite end opening on said pad supporting surface, and means operative in response to said output signal from said sensing means to deliver cleaning fluid from a supply thereof to said inlet of said supply duct.

5. A contact type roll cleaner as defined in claim 4, wherein said supply of cleaning fluid is maintained in a sealed tank, and said means for maintaining said sponge pad substantially saturated further comprises means connecting the interior of said tank to a source of compressed air, whereby upon operation of said fluid delivery means fluid is delivered under pressure to said inlet of said duct.

6. A contact type roll cleaner as defined in claim 4, wherein said moisture sensing means comprises a plurality of electrical moisture sensors mounted in said support member, each of said sensors having a conductivity probe at one end thereof extending into engagement with said sponge pad through a registering opening in said member, and disposed to be electrically connected at its opposite end to said fluid delivery means.

7. A contact type roll cleaner as defined in claim 1, wherein said cleaning cloth mounting means comprises, a first pair of axially spaced cylindrical spool supports mounted in said frame for rotation coaxially of one of said pair of axes, and disposed to support removably and coaxially therebetween the tubular spool for the cleaning cloth supply roll, a second pair of axially spaced cylindrical spool supports mounted in said frame for rotation coaxially of the other of said pair of axes, and disposed to support removably and coaxially therebetween the tubular spool for said cloth take-up roll, each of said first and second pairs of spool supports having on the confronting ends thereof circumferential flanges disposed to be engaged with predetermined pressure against opposite ends, respectively, of the spool supported therebetween, and means mounting said first pair of spool supports in said housing for limited movement axially of said one axis of said pair thereof, and for adjustment manually to set said predetermined pressure exerted by the associated flanges thereof against opposite ends of the spool for said cleaning cloth supply roll, thereby to adjust the tension in the cloth traveling from the supply roll to the takeup roll.

8. A contact type roll cleaner as defined in claim 7, wherein said mounting means for said first pair of spool supports comprises, a spring interposed between said frame and one end of one of said first pair of supports resiliently to urge the flange on said one support against one end of said supply spool, and a threaded member interposed between said frame and the other of said first pair of supports and rotatable selectively in opposite directions to shift said other support between an advanced position in which the flange thereof is engaged with the opposite end of said supply roll spool, and a retracted position in which said flange thereof is spaced a predetermined distance from said opposite end of said supply roll spool.

9. A contact type roll cleaner as defined in claim 8, including means for adjusting said predetermined distance between the last-named flange and said opposite end of said supply roll spool thereby to adjust said tension in said cleaning cloth.

10. In a contact type roll cleaner having a frame adjustably mounted at one end thereof on a drive mechanism for reciprocation thereby between first and second limit positions axially of a rotating processing roll that is to be cleaned, and with an opening in the opposite end of said frame confronting on said surface of the processing roll, a supply roll of cleaning cloth mounted in said frame for rotation about a first axis parallel to the axis of said processing roll, a cloth take-up roll mounted in said frame for rotation about a second axis spaced from and parallel to said first axis, drive means on said frame connected to said take-up roll and operable selectively and intermittently to cause cloth from said supply roll to be drawn to said take-up roll in a path which causes at least a part of said cloth to register with said opening in said opposite end of said frame, means mounting a sponge pad in said frame for movement relative to said frame between a retracted position in which the pad is spaced from the portion of the cleaning cloth in registry with said opening, and an advanced position in which said pad engages and urges said portion of the cleaning cloth into contact with said processing roll, means for momentarily moving said sponge pad to its retracted position each time said frame reaches one of its limit positions, and means for momentarily operating said drive means to advance a clean portion of cloth into registry with said opening when said sponge pad is moved to its retracted position.

11. In a contact type roll cleaner as defined in claim 10, including means for maintaining said sponge pad substantially saturated with cleaning fluid.

12. In a contact type roll cleaner as defined in claim 10, wherein said supply and take-up rolls are mounted to rotate between a pair of spaced sidewalls of said frame, a pair of axially spaced cylindrical roll supports are mounted in registering openings in said sidewalls for rotation and limited axial movement coaxially of said first axis, and having confronting ends thereof releasably engaged with opposite ends of said supply roll, a spring is interposed between said frame and one of said supports resiliently to urge said confronting end thereof into engagement with one end of said supply roll, and the other of said supports is mounted in said frame for manual adjustment axially of said first axis between a retracted position in which the confronting end thereof is spaced from the opposite end of said supply roll, and an advanced position in which said confronting end thereof is engaged with predetermined force against said opposite end of the supply roll.

13. In a contact type roll cleaner as defined in claim 12, including means for adjusting the force exerted by said other of said supports against said supply roll, thereby to adjust the tension in the cloth extending between said supply roll and said take-up roll.

* * * * *